US005217839A

United States Patent [19]

Yamada et al.

[11] Patent Number: 5,217,839

[45] Date of Patent: Jun. 8, 1993

[54] PREPARATION PROCESS OF TONER

[75] Inventors: Fumio Yamada, Yokosuka; Hiromitsu Kikuchi, Tokyo; Tsuyoshi Yamamoto, Yokohama; Jun Saito, Kawasaki; Shizuo Kitahara, Kawaguchi; all of Japan

[73] Assignees: Nippon Zeon Co., Ltd., Tokyo, Japan; Casco Nobel AB, Stockholm, Sweden

[21] Appl. No.: 630,612

[22] Filed: Dec. 20, 1990

[30] Foreign Application Priority Data

Jan. 16, 1990 [JP] Japan ..... 2-4612
Nov. 9, 1990 [JP] Japan ..... 2-305844

[51] Int. Cl.[5] ..... G03G 9/08

[52] U.S. Cl. ..... 430/137; 430/111; 524/718; 524/719; 524/720

[58] Field of Search ..... 430/137, 106.6, 111; 524/718, 719, 720

[56] References Cited

U.S. PATENT DOCUMENTS

| | | | |
|---|---|---|---|
| 3,391,082 | 7/1968 | Maclay . | |
| 3,634,251 | 1/1972 | Maeda et al. . | |
| 3,839,028 | 10/1974 | Tamai et al. | 430/109 |
| 3,992,561 | 11/1976 | Hargis et al. . | |
| 4,079,176 | 3/1978 | deZarauz . | |
| 4,092,268 | 5/1978 | deZarauz . | |
| 4,112,210 | 9/1978 | deZarauz . | |
| 4,129,705 | 12/1978 | deZarauz . | |
| 4,260,519 | 4/1981 | Aggarwal et al. . | |
| 4,297,240 | 10/1981 | Bingham et al. . | |
| 4,550,142 | 10/1985 | Akita et al. . | |
| 4,592,990 | 6/1986 | Takagi et al. | 430/138 |
| 4,647,625 | 3/1987 | Aonuma et al. . | |
| 4,772,541 | 9/1988 | Gottschalk et al. | 430/914 |
| 4,777,104 | 10/1988 | Matsumoto et al. | 430/109 |
| 4,845,007 | 7/1989 | Hyosu et al. | 430/137 |
| 4,957,841 | 9/1990 | Macholdt | 430/137 |
| 4,965,131 | 10/1990 | Nair et al. | 430/137 |
| 5,002,847 | 3/1991 | Utsumi et al. | 430/137 |
| 5,069,994 | 12/1991 | Gitzel et al. | 430/137 |

FOREIGN PATENT DOCUMENTS

| | | |
|---|---|---|
| 59-197053 | 3/1959 | Japan . |
| 60-57852 | 4/1960 | Japan . |
| 61-141452 | 6/1961 | Japan . |
| 36-10231 | 7/1961 | Japan . |
| 62-050768 | 3/1962 | Japan . |
| 58-158650 | 9/1983 | Japan . |
| 2147905 | 5/1985 | United Kingdom . |

OTHER PUBLICATIONS

C. Giordano et al., Synthesis, 92 (1971).
Caraculacu et al., [Polym. Lett. 6 451 (1968).
K. A. Ogloblin et al., J. Org. Chem., U.S.S.R., 1, 1370 (1965).
H. E. Zaugg et al., Synthesis, 49 (1970).
Rolf Huisgen, "⅓-Dipolare Cycloadditionen" Angew. Chem. 75., 604 (1963).
Tada et al, "Butadiene-Rubber Modified with ⅓-Dipolar Cycloaddion Reaction", Journal of Japan Rubber Society, 43, 996 (1970).
T. L. Gilchrist et al, "Decarboxylation and Fragmentation of 5,6-Dihydro-4H-1,2-oxazine-3-carboxylic Acids" J.C.S. Chem. Commun., 1090 (1979).
David E. Davies, Thomas L. Gilchrist and Tony G. Roberts, "The Cycloaddition of a-Nitrosostyrenes to Olefins, Investigations of the Scope and Mechanism of the Reaction" J. Chem. Soc. Perkin Trans. I, 1275 (1983).
Harold E. Zaugg, "a-Amidoalkylation at Carbon: Recent Advances—Parts I and II", Synthesis 85 Synthesis, 1982 (1984) and Synthesis 49 (1970).

*Primary Examiner*—Marion E. McCamish
*Assistant Examiner*—Christopher D. PoDee
*Attorney, Agent, or Firm*—Lowe, Price, LeBlanc & Becker

[57] ABSTRACT

Disclosed herein is a process for the preparation of a toner, which comprises dissolving or dispersing a compound having at least one $>C{=}N^{\oplus}<$ bond in its molecule and a colorant in a vinyl monomer and then suspension-polymerizing the vinyl monomer in an aqueous dispersion medium.

10 Claims, No Drawings

PREPARATION PROCESS OF TONER

FIELD OF THE INVENTION

This invention relates to a process for the preparation of a toner useful in developing electrostatic latent images and suitable for use in electrophotography, electrostatic recording, electrostatic printing, etc., and more specifically, to a process for the preparation of a toner with a colorant finely and uniformly dispersed in a fixing thermoplastic resin.

BACKGROUND OF THE INVENTION

As toners for developing electrostatic latent images in electrophotography and the like, there have been widely used those obtained by granulating compositions comprising a fixing resin medium such as a thermoplastic resin, a colorant such as carbon black dispersed in the resin medium and other property-imparting agents.

It has heretofore been used, as a preparation process of toners, to add a pigment such as carbon black and/or magnetic powder, a dye suitable for use in charge-controlling as needed, etc. to a fixing thermoplastic resin composed of a natural or synthetic polymer, premix the resulting mixture by a mixer, melt and knead it in a heated kneader such as a hot mill or extruder so as to disperse the pigment and dye in the resin, cool the dispersion, granulate it coarsely and then finely, and then classify the resulting particles so as to provide particles having a desired particle size.

However, such a preparation process is complicated in process and is insufficient in uniform dispersibility though it requires a long-time kneading at an elevated temperature in order to enhance the dispersibility of the pigment in the resin. It is hence difficult to obtain a toner having uniform electric and magnetic properties and satisfactory developability.

On the other hand, it has been proposed, as a process for directly providing a toner without using any grinding processes, to add a pigment and dye to at least one polymerizable monomer, emulsion- or suspension-polymerize the monomer so as to form a finely divided resin containing the pigment and dye, and then wash and dry the resulting fine particles (for example, Japanese Patent Publication No. 10231/1961, U.S. Pat. Nos. 3,391,082 and 3,634,251).

However, this process often encounters the following problem. Namely, since the magnetic powder and pigment having hydrophilic surface characteristics are poor in wettability to the monomer, it is difficult to uniformly disperse them in the monomer and further in the resulting particles. Therefore, it is only possible to obtain a toner poor in electric properties because most of the pigment and magnetic powder adhere on the surfaces of the resulting particles.

In order to solve such a problem, it has been conducted to disperse carbon black and the like in a monomer in the presence of an organic titanate coupling agent (Japanese Patent Application Laid-Open No. 158650/1983) or to subject likewise a pigment such as carbon black and magnetic powder to a surface treatment with a silane coupling agent, titanium coupling agent, aluminum coupling agent or the like. It has however been impossible to attain sufficient effects therefrom.

OBJECTS AND SUMMARY OF THE INVENTION

The present invention has been made with a view toward overcoming the various defects of the toners according to the known granulation and polymerization processes as described above.

It is an object of this invention to provide an electrophotographic toner comprising a colorant such as magnetic powder or carbon black dispersed uniformly in a fixing thermoplastic resin, and having good electric and magnetic properties and developability.

Another object of this invention is to provide a novel and simple process for preparing a toner comprising at least one colorant dispersed uniformly therein and having good developability.

The present inventors have carried out an extensive investigation with a view toward overcoming the above-mentioned problems involved in the prior art. As a result, it has been found that when a compound having at least one $>C{=}\oplus<$ bond in its molecule is used as a dispersing agent for a colorant, and this compound and the colorant are dissolved or dispersed in a vinyl monomer, followed by suspension polymerization of the monomer in an aqueous dispersion medium, a toner comprising the colorant dispersed uniformly therein and having good developability can be obtained. It has also been found that when a colorant subjected to a surface treatment with the above-described compound in advance is used, a toner having excellent physical properties can also be obtained.

The present invention has been led to completion on the basis of these findings.

According to this invention, there is thus provided a process for the preparation of a toner, which comprises dissolving or dispersing a compound having at least one $>C{=}N^{\oplus}<$ bond in its molecule and a colorant in a vinyl monomer and then suspension-polymerizing the vinyl monomer in an aqueous dispersion medium.

Here, the above-described compound and colorant may be separately dissolved or dispersed in the vinyl monomer, or the colorant subjected to a surface treatment with the compound in advance may be dissolved or dispersed in the vinyl monomer.

DETAILED DESCRIPTION OF THE INVENTION

Features of the present invention will hereinafter be described in detail.

Compound Having At Least One $>C{=}N^{\oplus}<$ Bond In Its Molecule)

With respect to the compound to be used as a dispersing agent in this invention, the following two preparation processes (A) and (B) will be described separately.

(A) Compound Having $>C{=}N^{\oplus}<$ Bond In Its Molecule and Its Preparation Process—First Process Heterocycle-containing compounds having at least one heterocycle, which contains a $>C{=}N^{\oplus}<$ bond, on the ends of their molecular chains or within their molecular chains (in their principal chains or side chains) are representative of such a compound.

Specific examples of such heterocycle-containing compounds are represented by the following general formulae (1a)–(5b).

By the way, the term "compounds having a 1,3-oxazine structure in molecule", which will be described subsequently, in this invention denotes heterocycle-containing compounds having 0 and N in the 1,3-positions in the 6-membered ring and means not only compounds having a typical 1,3-oxazine ring but also compounds having a heterocycle of a structure in which the double bonds in the 6-membered ring have been saturated in part or in whole, such as a 4H,5H-1,3-oxazine ring, or a heterocycle different in positions of double bonds from the typical 1,3-oxazine ring. This also applies to heterocycles represented by other general terms.

As exemplary compounds having such a heterocyclic structure, may be mentioned (1) compounds having any one of the above-described 1,3-oxazine structures, in which N in the heterocycle has been converted into a quaternary ammonium salt [formulae (1a) and (1b)], (2) compounds having a 1,3-thiazine ring or 5H,6H-1,3-thiazine ring, in which N in the thiazine ring has been converted into a quaternary ammonium salt [formulae (2a) and (2b)], (3) compounds having an isoxazole ring or 4H,5H-1,3-isoxazole ring, in which N in the isoxazole ring has been converted into a quaternary ammonium salt [formulae (3a) and (3b)], (4) compounds having a 1,2-diazole ring or 4H,5H-1,2-diazole ring, in which N in the diazole ring has been converted into a quaternary ammonium salt [formulae (4a) and (4b)], and (5) compounds having a 2H-pyrrole ring or 2H,3H,4H-pyrrole ring, in which N in the pyrrole ring has been converted into a quaternary ammonium salt [formulae (5a) and (5b)].

The compounds having such a heterocyclic structure include those obtained by using a compound having a carbon-carbon unsaturated bond on the end of its molecular chain or within its molecular chain (in its principal chain or side chain), for example, an α-olefin having a long-chain alkyl group, a low-molecular weight polyethylene, an oligomer of an α-olefin or a polymer having unsaturated bond(s) in its molecular chain such as polystyrene methacrylate to introduce any one of the atomic groups (heterocyclic structures) represented by the following general formulae in its molecule (within its molecular chain or on one end of its molecular chain) in accordance with any one of the chemical reactions which will be described subsequently.

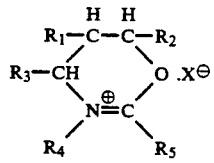

(1a)

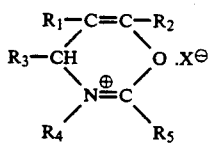

(1b)

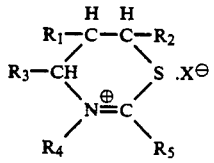

(2a)

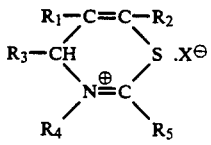

(2b)

-continued

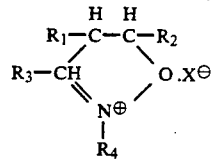

(3a)

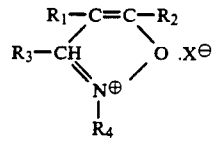

(3b)

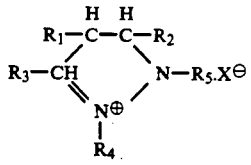

(4a)

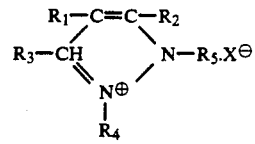

(4b)

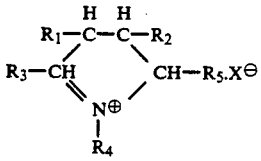

(5a)

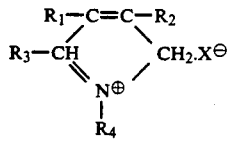

(5b)

wherein $R_1$ means a principal chain of each compound, $R_2$ denotes a principal chain of the compound, a hydrogen atom or a hydrogen residuum having at most 6 carbon atoms, $R_3$–$R_5$ may be equal to or different from one another and stand individually for a hydrocarbon residuum, some of said hydrocarbon residua may being substituted by a substituent such as a halogen atom, or a nitro, epoxy, carboxyl or hydroxyether group, and $X^{\ominus}$ represents an anion.

Preparation Process

The compound containing at least one of such heterocyclic structures can be prepared using, as a starting material, a compound having at least one carbon-carbon unsaturated bond such as carbon-carbon double or triple bond in its molecular chain (at the end of its molecular chain or within its molecular chain).

As exemplary starting compounds having an unsaturated bond at one ends of their molecular chains, may be mentioned α-olefins having a long-chain alkyl group, such as 1-decene, 1-dodecene, 1-tetradecene, 1-hexadecene, 1-heptadecene, 1-octadecene, 1-eicosene, 1-tridecene and 2-methyl-1-undecene; low-molecular weight polymers or oligomers such as low-molecular weight polyethylene, liquid or low-molecular weight polypropylene, copolymers of propylene and a diene, and oligomers of α-olefins; and polymers such as polybutene, polyisobutylene, copolymers of isobutylene and a diene, polyethylene glycol dimethacrylate, polyethylene glycol diallylate, polypropylene glycol diallylate, polystyrene methacrylate and polystyrene allylate.

As exemplary starting compounds having at least one unsaturated bond within their molecular chains, may be mentioned organic compounds having a —C=C— bond, such as 1,9-decadiene, 2,3-dimethylbutene, 2,5-hexadiene, 7-tetradecene and 2,4,4-trimethyl-2-pentene; unsaturated polyesters; polymers or copolymers of butadiene, isoprene, piperylene, dicyclopentadiene and ethylidenenorbornene; copolymers of a conjugated diene and a vinyl monomer, for example, polybutadiene, polyisoprene, styrene-butadiene random copolymers, styrene-butadiene block copolymers (for example, A-B type and A-B-A type, wherein A and B mean a polystyrene block and a polybutadiene block, respectively), styrene-isoprene random copolymers, styrene-isoprene block copolymers (for example, A-B type and A-B-A type, wherein A and B mean a polystyrene block and a polyisoprene block, respectively), acrylonitrile-butadiene copolymers, butadiene-propylene block copolymers, ethylene-propylene-diene monomer copolymers and alkyl methacrylate-butadiene copolymers; and partially hydrogenated products thereof.

As exemplary compounds having a —C≡C— bond, may be mentioned organic compounds such as 1-decyne, 3,3-dimethyl-1-butyne, heptynes, hexynes, 1,8-nonadiyne and octynes.

Any compounds may be used as a starting material in this invention so long as they have a carbon-carbon unsaturated bond at one ends of their molecular chains or within their molecular chains. No particular limitation is imposed on their molecular weights. They may include various compounds from low-molecular weight organic compounds and oligomers to high-molecular weight, solid polymers (for example, high polymers having a molecular weight of about hundreds of thousands).

No particular limitation is imposed on the preparation process of the compounds having such a heterocyclic structure. Some of the representative preparation processes will be described below.

(1) There is a process in which an organic compound (I) represented by the following general formula:

$$Y_1—CH=N—Y_2 \quad (I)$$

$Y_1$ and $Y_2$ mean individually an organic atomic group, and an organic acid halide are reacted with the above-described compound having at least one carbon-carbon unsaturated bond in its molecular chain in the presence of a Lewis acid.

Described specifically, the organic compound (I) is a compound wherein $Y_1$ and $Y_2$ are individually an aliphatic, alicyclic or aromatic residuum which may suitably have at least one atomic group such as an alkoxyl, cyano, carboxyl or dialkylamino group. As specific examples of the compound, may be mentioned benzylidene-methylamine, benzylidene-butylamine, benzylideneaniline, benzylidene-cyclohexylamine, propylideneaniline, ethoxybenzylidene-butylamine, 4-carbomethoxybenzylidene-buthylaniline, benzylidene-4-cyanoaniline, dimethylaminobenzylidene-butylaniline, etc.

As specific examples of the organic acid halide, may be mentioned acetyl chloride, acetyl bromide, benzoyl chloride, acrylic acid chlorides, carbomethoxybenzoyl chloride, cinnamic acid chlorides, methacrylic acid chlorides, etc.

As examples of the Lewis acid, may be mentioned $BF_3$, $BF_3O(C_2H_5)_2$, $AlCl_3$, $TiCl_4$, $SnCl_4$, $SbCl_5$, $AgBF_4$, etc.

No particular limitation is imposed on reaction conditions and the like. In general, the reaction mixture is reacted for about 1-2 hours at 20°-80° C. in an inert solvent such as benzene, toluene or cyclohexane. Usually, the amounts of the organic compound (I) and organic acid halide are each about 1-1.5 moles per mole of the unsaturated compound and the amount of the Lewis acid is about 0.1-1 mole per mole of the organic acid halide. In the case where the unsaturated compound is a polymer, the amounts of the organic compound (I) and organic acid halide to be used are each about 0.1-30 parts by weight per 100 parts by weight of the polymer.

(2) There is another process in which an N-hydroxymethylamide (N-methylol compound) is reacted with the above-described compound having at least one carbon-carbon unsaturated bond in its molecular chain in the presence of a Friedel-Crafts catalyst and, if necessary, the resultant product is reacted further with an alkyl halide, methyl p-toluenesulfonate, dimethylsulfuric acid or the like, thereby achieving N-alkylation.

The N-hydroxymethylamide compound is a reaction product of an amide compound and an aldehyde compound. As the aldehyde compound, may be used aliphatic and aromatic aldehydes such as formalin, butyraldehyde, valeraldehyde and benzaldehyde, and the like. As examples of the amide compound, may be mentioned acetoamide, benzamide, methoxybenzamide, nitrobenzamide, N-methylbenzamide, butyramide, phthalamide, glutaric amide, etc. Copolymers comprising, as one component, an N-methylolacrylamide monomer may also be used as the N-hydroxymethylamide compound.

As the alkyl halide, may be used principally benzyl bromide, benzyl chloride, bromohexane, bromopropane, 2-chloroethyl ether, chloromethyl ether, chloropentane and the like.

As the Friedel-Crafts catalyst, may be used any conventionally known catalysts. Typical examples of such a catalyst are halides of metals or metalloides. The catalysts includes, for example, halides of elements such as B, Al, Si, P, Ti, V, Fe, Zn, Mo, Sn, Sb, Te and W, and oxygen-element compounds such as PO, $SO_2$ and VO, organic halides and complexes thereof.

As further specific examples thereof, may be mentioned $BF_3$, $BF_3O(C_2H_5)_2$, $BCl_3$, $AlCl_3$, $TiCl_4$, $SnCl_4$, $FeCl_3$, $WCl_6$, $POCl_3$, $(C_2H_5)_3$, etc.

No particular limitation is imposed on reaction conditions [Details of this reaction are described in, for example, C. Giordano et al., SYNTHESIS, 92 (1971)].

(3) There is a further process in which a nitrile oxide, nitrile imine or nitrile ylide is reacted with the above-described compound having at least one carbon-carbon unsaturated bond in its molecular chain to add it to the unsaturated bond, thereby conducting a reaction known as the 1,3-dipole addition reaction and thereafter, the reaction product is reacted with an alkyl halide, dimethylsulfuric acid or the like, thereby achieving N-alkylation.

The 1,3-dipole addition reaction is described in detail in Huisgen, Angew. Chem. 75, 604 (1963).

The reaction introducing an isoxazoline ring with the nitrile oxide followed the literature by Tada, Numata et al. [Journal of Japan Rubber Society, 43, 996 (1970)].

Besides, the reaction introducing an pyrazoline ring with the nitrile imine followed the literature by Caraculacu et al. [Polym. Lett., 6, 451 (1968)].

(4) There is a still further process in which a halohydroxyimino compound is reacted with the above-described compound having at least one carbon-carbon unsaturated bond in its molecular chain in the presence of a dehydrochlorinating agent such as an anhydrous sodium carbonate and, if necessary, the resultant product is reacted further with an alkyl halide, dimethylsulfuric acid or the like, thereby achieving N-alkylation.

The halohydroxyimino compound can be obtained either by reacting hydroxylamine hydrochloride with α-haloaceto compound as described in T. L. Gilchrist et al., J. C. S. Chem. Commun., 1090 (1979) or by reacting nitrosyl chloride with a vinyl compound such as acrolein, acrylic ester or α-methylstyrene as described in K. A. Ogloblin et al., J. Org. Chem., U.S.S.R., 1, 1370 (1965).

The synthesis of the compounds having an oxazine structure by the reaction of an olefin and the halohydroxyimino compound followed the process described in T. L. Gilchrist et al., J. Chem. Soc. Perkin Trans. I, 1275 (1983).

The synthesis of other compounds having an oxazine structure are described in detail in H. E. Zaugg et al., Synthesis, 85 (1984), Synthesis, 182 (1984) and Synthesis, 49 (1970).

By the way, the carbon-carbon unsaturated bonds in the molecular chains of the various kinds of the compounds can be modified in accordance with the above-described processes to introduce their corresponding heterocyclic structures therein. However, unmodified compounds may be contained in part.

The above-described compounds having the heterocycle may be substituted at least in part by a substituent such as a halogen atom, or a nitro, epoxy, carboxyl or hydroxyether group, if desired.

(B) Compound Having $>C\alpha N^{\oplus}<$ Bond In Its Molecule and Its Preparation Process—Second Process Another typical example of such a compound is the following compound.

Namely, a modified polymer obtained by reacting an organic compound, which will be described subsequently, with (1) a living anionic polymer obtained by polymerizing at least one monomer polymerizable by a catalyst based on a metal such as an alkali metal and/or alkaline earth metal (so-called anionic polymerization catalyst), and having the metal at its terminal or (2) a polymer which has been obtained by adding the above-mentioned metal by an after reaction to an unsaturated polymer having double bonds in its polymer chain or side chain, and then hydrolyzing the reaction product; or another modified polymer obtained by hydrogenating the double bonds in the polymer chain of the modified polymer thus obtained (U.S. Pat. Nos. 4,550,142 and 4,647,625).

As the polymerization catalyst based on the above metal, may be used any catalysts used conventionally in anionic polymerization. No particular limitation is imposed thereon.

As typical examples of the alkali metal-based catalyst, may be mentioned organic lithium compounds having 2–20 carbon atoms such as n-butyl lithium and sec-butyl lithium.

As exemplary alkaline earth metal-based catalysts, may be mentioned catalyst systems comprising, as a principal component, a compound of barium, strontium, calcium or the like, which are disclosed in U.S. Pat. Nos. 3,946,385, 3,992,561, 4,079,176, 4,092,268, 4,112,210, 4,129,705, 4,260,519 and 4,297,240, but not limited thereto.

The polymerization reaction and the alkali metal- and/or alkaline earth metal-adding reaction are conducted in a hydrocarbon solvent used conventionally in anionic polymerization or a solvent by which the metal-based catalyst is not ruined, such as tetrahydrofuran, tetrahydropyran or dioxane.

As exemplary monomers polymerizable by the anionic polymerization catalyst, may be mentioned aromatic vinyl hydrocarbons such as styrene, p-methylstyrene, 1,3-dimethylstyrene, α-methylstyrene, vinylnaphthalene, vinylanthracene, conjugated dienes such as 1,3-butadiene, isoprene, 1,3-pentadiene and 1,3-hexadiene, and mixtures thereof.

As exemplary unsaturated polymers having double bonds in its polymer chain or side chain, may be mentioned unsaturated polyesters; polymers or copolymers of butadiene, isoprene, piperylene, dicyclopentadiene and ethylidenenorbornene; copolymers of a conjugated diene and a vinyl monomer, for example, polybutadiene, polyisoprene, styrene-butadiene random copolymers, styrene-butadiene block copolymers (for example, A-B type and A-B-A type, wherein A and B mean a polystyrene block and a polybutadiene block, respectively), styrene-isoprene random copolymers, styrene-isoprene block copolymers (for example, A-B type and A-B-A type, wherein A and B mean a polystyrene block and a polyisoprene block, respectively), acrylonitrile-butadiene copolymers, butadiene-propylene block copolymers, ethylene-propylene-diene monomer copolymers and alkyl methacrylate-butadiene copolymers; and partially hydrogenated products thereof.

As examples of the organic compound used in the above-described reaction, may be mentioned N-substituted such as N-methyl-β-propiolactam, N-t-butyl-β-propiolactam, N-phenyl-β-propiolactam, N-methoxyphenyl-β-propiolactam, N-naphthyl-β-propiolactam, N-methyl-2-pyrrolidone, N-t-butyl-2-pyrrolidone, N-phenyl-2-pyrrolidone, N-methoxyphenyl-2-pyrrolidone, N-vinyl-2-pyrrolidone, N-benzyl-2-pyrrolidone, N-naphthyl-2-pyrrolidone, N-methyl-5-methyl-2-pyrrolidone, N-t-butyl-5-methyl-2-pyrrolidone, N-phenyl-5-methyl-2-pyrrolidone, N-methyl-3,3'-dimethyl-2-pyrrolidone, N-t-butyl-3,3'-dimethyl-2-pyrrolidone, N-phenyl-3,3'-dimethyl-2-pyrrolidone, N-methyl-2-piperidone, N-t-butyl-2-piperidone, N-phenyl-2-piperidone, N-methoxyphenyl-2-piperidone, N-vinyl-2-piperidone, N-benzyl-2-piperidone, N-naphthyl-2-piperidone, N-methyl-3,3'-dimethyl-2-piperidone, N-phenyl-3,3'-dimethyl-2-piperidone, N-methyl-ε-caprolactam, N-phenyl-ε-caprolactam, N-methoxylphenyl-ε-caprolactam, N-vinyl-ε-caprolactam, N-benzyl-ε-caprolactam, N-naphthyl-ε-caprolactam, N-methyl-ω-laurylolactam, N-phenyl-ω-laurylolactam, N-t-butyl-ω-laurylolactam, N-vinyl-ω-laurylolactam and N-benzyl-ω-laurylolactam, and their corresponding thiolactams; compounds having a $$-\underset{\underset{X}{\|}}{C}-N<$$

bond, wherein X means an O or S atom, in their molecules, such as N-substituted ethylene ureas, for example, 1, 3-dimethylethylene urea, 1,3-diethylethylene urea, 1,3-diphenylethylene urea, 1,3-di-t-butylethylene urea and 1,3-divinylethylene urea, and their substituted aminoketones such as 4-dimethylaminobenzophenone, 4-diethylaminobenzophenone, 4-di-t-butylaminobenzophenone, 4-diphenylaminobenzophenone, 4,4'-bis(dimethylamino)benzophenone, 4,4'-bis(diethylamino)benzophenone, 4,4'-bis(d-t-butylamino)benzophenone, 4,4'-bis(diphenylamino)benzophenone, 4,4'-bis(divinylamino)benzophenone, 4-dimethylaminoacetophenone, 4-diethylaminoacetophenone, 1,3-bis(diphenylamino)-2-propanone and 1,7-bis(methylethylamino)-4-heptanone, and their corresponding N-substituted aminothioketones; and N-substituted aminoaldehydes such as 4-dimethylaminobenzaldehyde, 4-diphenylaminobenzaldehyde and 4-divinylaminobenzaldehyde, and their corresponding N-substituted aminothioaldehydes.

The amount of these organic compounds to be used preferably falls within a range of 0.05–10 moles per mole of the alkali metal and/or alkaline earth metal-based catalyst which is used upon the addition of its metal to the polymer by the anionic polymerization or after reaction, with a range of 0.2–2 moles being more preferable.

The reaction is allowed to proceed at a temperature ranging from room temperature to 100° C. and is terminated upon an elapsed time of from several seconds to several hours. After the completion of the reaction, an intended polymer with the above-described functional group being bonded thereto is recovered from the reaction solution by steam stripping.

As an example of the above-described reactions, the reaction making use of 4,4'-bis(diethylamino)benzophenone can be illustrated as follows.

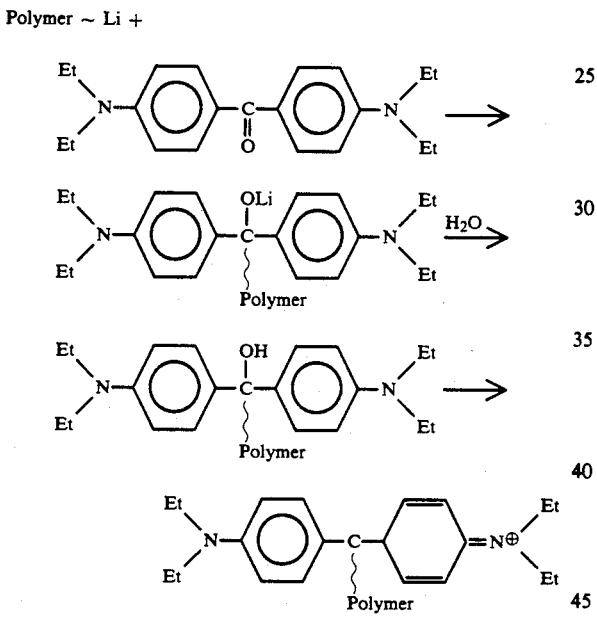

Preparation Process Of Toner

The toner according to this invention can be obtained by dissolving or dispersing the compound having at least one >C=N⊕< bond together with the colorant and other additives in the monomer component and then suspension-polymerizing the monomer component usually at a temperature of 30°–200° C. in the present of an oil-soluble polymerization initiator in an aqueous dispersion medium. On the other hand, as the usage of the compound A, it may be used either by adding during the mixing process of the vinyl monomer and the colorant or by treating the surface of the colorant with the compound A and then adding and mixing the thus-treated colorant to and with the vinyl monomer.

Although no particular limitation is imposed on the method of treating the surface of the colorant, the following methods may be mentioned by way of example. Namely, a method wherein the compound having at least one >C=N⊕< bond in its molecule is dissolved in a solvent and the colorant is then added to the solution under stirring to disperse it, and a method wherein a solution of the compound A in a solvent is sprayed on the colorant fluidized.

Vinyl Monomer

As exemplary vinyl monomers useful in the practice of this invention, may be mentioned styrene monomers such as styrene, vinyltoluene and α-methylstyrene; acrylic and methacrylic monomers such as acrylic acid, methacrylic acid, methyl acrylate, ethyl acrylate, propyl acrylate, butyl acrylate, 2-ethylhexyl acrylate, ethyl methacrylate, propyl methacrylate, butyl methacrylate, 2-ethylhexyl methacrylate, dimethylaminoethyl methacrylate, acrylonitrile and acrylamide; ethylenically unsaturated monoolefin such as ethylene, propylene and butylene; halogenated vinyls such as vinyl chloride, vinilidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These vinyl monomers may be used singly, or a plurality of the monomers may be combined for use to copolymerize them.

Together with these monomers, may be used any suitable crosslinking agents, for example, aromatic divinyl compounds such as divinylbenzene, divinylnaphthalene and derivatives thereof; di- or triethylenically unsaturated carboxylic acid esters such as ethylene glycol dimethacrylate, diethylene glycol dimethacrylate, triethylene glycol dimethacrylate, trimethylolpropane triacrylate and 1,3-butanediol dimethacrylate; divinyl compounds such as N,N-divinylaniline, divinyl ether, divinyl sulfide; and compounds having three or more vinyl groups. These crosslinking agents may be used either singly or in combination. The amount of these crosslinkable monomers to be used falls within a range of 0–20 wt. % of the whole monomer component including the vinyl monomer. Accordingly, "vinyl monomer" or "monomer component" in this invention means a single vinyl monomer or a monomer mixture containing one or more of the above-mentioned crosslinkable monomers, as desired.

Colorant

As exemplary colorants useful in the practice of this invention, may be mentioned pigments and dyes such as carbon black, aniline black, crystal violet, rhodamine B, malachite green, nigrosine, copper phthalocyanine and azo dyes. These colorants may be used either singly or in combination.

In addition, one or more of high-polar substances referred to as charge control agent in this field, such as nigrosine dyes, monoazo dyes, metallized dyes, zinc hexadecylsuccinate, alkyl esters and alkyl amides of naphthoic acid, nitrohumic acid, N,N'-tetramethyldiamine benzophenone, N,N'-tetramethylbenzidine, triazine and metal complexes of salicylic acid may be combined for use.

As further colorants, may also be mentioned metal oxides such as titanium oxide, silicon dioxide and zinc oxide; and magnetic powders such as iron, cobalt, nickel, iron sesquioxide, triiron tetraoxide, manganese iron oxide, zinc iron oxide and nickel iron oxide.

When a magnetic powder is used for the purpose of obtaining toner particles having a particle size of about 2–50 μm, it is desirable that the magnetic powder used should have a particle size of at most 1 μm.

No particular limitation is imposed on the amount of the colorant to be used. In general, it is usually 5–20 parts by weight per 100 parts by weight of the polymer as a fixing (binding) resin, for carbon black used in binary toner. In the case of magnetic powder used in magnetic powder-containing toner on the other hand, it is relatively great and is 50–300 parts, preferably 90–200 parts by weight.

Polymerization

The suspension polymerization is usually conducted by dispersing the monomer component in a medium (mainly, water) not dissolving the monomer component and making use of a polymerization initiator insoluble in the medium but soluble in the monomer component.

Upon the polymerization, a dispersion stabilizer is used in a range of 0.01–20 wt. % of the monomer component. As exemplary dispersion stabilizers, may be mentioned water-soluble polymers such as polyvinyl alcohol, starch, methyl cellulose, carboxymethyl cellulose, hydroxyethyl cellulose, sodium polymethacrylate; and inorganic substances such as barium sulfate, calcium sulfate, aluminum sulfate, calcium carbonate, calcium phosphate, talc, clay, diatomaceous earth and metal oxide powders. As the polymerization initiator, may be used any oil-soluble initiators of the peroxide or azo type, which have been conventionally used in suspension polymerization. As specific examples, may be mentioned peroxide-type initiators such as benzoyl peroxide, octanoyl peroxide, ortho-methoxybenzoyl peroxide, methyl ethyl ketone peroxide, cumene hydroperoxide and t-butyl hydroperoxide; and azo-type initiators such as 2,2'-azoisobutyronitrile, 2,2'-azobis(2,4-dimethylvaleronitrile), 2,2'-azobis-2,3-dimethylbutyronitrile, 2,2'-azobis-2,3,3-trimethylbutyronitrile, 2,2'-azobis-2-isopropylbutyronitrile, 4,4-azobis-4-cyanovaleric acid and dimethyl 2,2'-azobisisobutyrate. The polymerization initiator is used in a proportion of, generally 0.01–20 wt. %, preferably 0.1–10 wt. % of the monomer component.

In order to prepare the toner by the suspension polymerization, at least one of the compounds A is dissolved in the monomer component, and the resultant solution is added with the polymerization initiator and colorant under stirring to prepare a dispersion. This dispersion is added into a medium with the dispersion stabilizer added thereto, followed by agitation in such a manner that droplets of the dispersion are controlled to a particle diameter within a predetermined range. The dispersion was then heated to a predetermined temperature to initiate the polymerization. After completion of the polymerization, an intended toner is recovered by any suitable separation means.

The amount of the colorant to be used is suitably determined depending upon the end application intended of the toner according to this invention, and hence no particular limitation is imposed thereon. It is generally 0.1–300 parts by weight, preferably 1–200 parts by weight per 100 parts by weight of the monomer component.

No particular limitation is also imposed on the amount of the compound used as the dispersing agent. Although it varies depending upon the property and particle diameter of the colorant, the content of the atomic group having the $>C{=}N^{\oplus}<$ bond in the compound A, etc., it is generally at least 0.05 part, preferably 0.5–500 parts, particularly preferably 1–100 parts by weight par 100 parts by weight of the colorant. Incidentally, when the colorant subjected to the surface treatment with the compound A is used, it is possible to reduce the amount of the compound A further used singly or even to omit its single use.

Although the particle diameter of the toner can be controlled as necessary, it is generally 1–30 μm, preferably 5–20 μm.

Other Component

In this invention, it is possible to simultaneously contain or subsequently add, into the toner in addition to the above-described essential components, an additive for controlling charge characteristics, electric conductivity, flowability or adhesion properties to a photosensitive body or fixing roll.

Such additives include releasing agents such as low-molecular weight polyethylene, low-molecular weight polypropylene and various kinds of waxes; dyes such as metallized dyes and nigrosine dyes; inorganic fine powders such as carbon black powder, silica powder, cerium oxide powder and zinc oxide powder; and the like.

ADVANTAGES OF THE INVENTION

According to this invention, there can be thus provided a toner in which various colorants have been dispersed more uniformly in a fixing thermoplastic resin compared with the toners in the prior art. The toner of this invention is excellent in developability and transferability and it is hence possible to form high-density images. In addition, since the electric properties among individual toner particles are uniform and a toner having a narrow charge distribution can hence be obtained, an image quality uniform and stable over a long period of time can be formed.

Furthermore, the affinity of the various colorants for the monomer component becomes extremely good. It is therefore possible to reduce energy consumed in dispersing upon the preparation of the toner.

EMBODIMENT OF THE INVENTION

The present invention will hereinafter be described specifically by the following Examples and Synthesis Example. However, it is not intended to be limited to these examples only. Incidentally, all designations of "part" or "parts" and "%" as will be used in the Examples and Synthesis Examples mean part or parts by weight and wt. % unless otherwise indicated.

Synthesis Example:—Synthesis Experiment of Compounds Having A $>C{=}N^{\oplus}<$ Bond In Their Molecules Each 100 g of polymers having unsaturated bonds as shown in Table 1 were separately dissolved in 500 ml of benzene. Each of the resulting solutions was charged in a reaction vessel equipped with a stirrer, interior-heating device, condenser and liquid-solid feed inlet. The solution was heated to 60° C. under stirring.

Each 0.1 mole of reagents A and B shown in Table 1 were added to the solution and the resultant mixture was reacted for about 1 hour. After completion of the reaction, the reaction mixture was poured into 1 l of methanol to completely solidify a reaction product. The resulting product was dried in a vacuum dryer.

The thus-obtained reaction products I and II were used in the following Examples.

Incidentally, the identification and determination of the >C=N⊕< group in the reaction products after the completion of the reaction were conducted by using gel permeation chromatography (GPC) under the following conditions and determining the ratio of the ultraviolet absorption intensity ($S_1$) at the wavelength (315 nm) characteristic of said group to the intensity ($S_2$) found by a refractometer.

Measuring conditions for GPC

Column: GMH-6 (product of TOSOH CORP.) 2 columns

Temperature: 38° C.

Flow rate: 1.2 ml/min

Solvent: chloroform

TABLE 1

| | Dispersing agent I | Dispersing agent II |
|---|---|---|
| Polymer having unsaturated bond | Styrene-butadiene random copolymer (ST/BD = 90/10, Mw = 50,000) | Styrene-butadiene block copolymer (ST/BD = 90/10, Mw = 20,000) |
| Reagent A | Benzylidene-butylamine 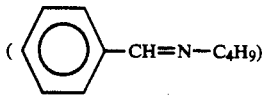 | |
| | Acetyl chloride ($CH_3COCl$) | |
| Reagent B | Tin tetrachloride | Titanium tetrachloride |
| $S_1/S_2$ | 3.1 | 2.8 |

EXAMPLE 1

Dispersed in an ball mill at room temperature, were parts of styrene, 30 parts of butyl methacrylate, 4 70 parts of Dispersing agent II prepared in Synthesis Example, 8 parts of carbon black ("Printex 150T", trade name), 0.5 part of a Cr dye ("Bontron S-34", trade name) and 2 parts of 2,2'-azobis(2,4-dimethylvaleronitrile), thereby obtaining an intimate mixture.

The mixture was then added into 350 parts of purified water with 5 parts of calcium phosphate finely dispersed therein to obtain an aqueous dispersion.

The aqueous dispersion was subjected to high-shear agitation by a rotor-stator type homomixer under conditions of at least pH 9 to finely disperse the mixture in water.

This aqueous dispersion of the monomer component was then charged in a reactor equipped with an agitating blade to polymerize the monomer component under stirring for 4 hours at 65° C.

After the thus-obtained polymer dispersion was thoroughly washed with an acid and water, the polymer was separated and dried to obtain a toner material. Its particle size was 11.8 μm for volume average particle and 10.5 μm for number average particle diameter, and it hence had an extremely narrow particle size distribution.

To 100 parts of the toner material, 0.3 part of hydrophobic silica was further added, thereby obtaining a toner.

The cut section of the toner thus obtained was observed through an electron microscope. As a result, it was found that carbon black was dispersed uniformly inside the particles. Its electric resistivity was 11.3 logΩ.cm as measured under conditions of 30° C. and 1 kHz. Its charge acceptance was −20 μc/q. The toner substantially contained no reversely charged particle and was extremely narrow in charge distribution.

Using the toner, a twenty thousand-sheet continuous copy test was conducted by a commercially available copying machine ("Leodry 8411" manufactured by TOSHIBA CORP.). The transfer efficiency was as high as 92%, and the density of an image formed was 1.38 and was not reduced even upon the twenty thousandth copying. The image was free of any fog, unevenness and dust, and was vivid and hence good in quality.

EXAMPLE 2

Dispersed in an ball mill at room temperature, were 80 parts of styrene, 20 parts of butyl methacrylate, 2 parts of Dispersing agent I prepared in Synthesis Example, 5 parts of colored pigment ("Carmine Blue GNR-0", trade name), 1 part of a dye ("Bontron E-87", trade name) and 2 parts of 2,2'-azobis(2,4-dimethylvaleronitrile), thereby obtaining an intimate mixture.

A toner was then prepared in accordance with the same procedure as in Example 1.

For the resulting toner, the pigment was dispersed uniformly inside the particles. Its electric resistivity was 11.5 logΩ.cm, and its charge acceptance was −18 μc/q. The toner substantially contained no reversely charged particle and was extremely narrow in charge distribution.

Using the toner, twenty thousand-sheet continuous copy tests were conducted by the commercially available copying machine respectively under conditions of normal temperature and humidity (23° C., 55% RH), and high temperature and humidity (30° C., 80% RH). The densities of images formed were 1.20 and 1.25, respectively, and were not reduced even upon the twenty thousandth copying. The image was free of any fog, unevenness and dust, and was vivid and hence good in quality.

EXAMPLE 3

Ten parts of Dispersing agent I prepared in Synthesis Example and 100 parts of carbon black ("Regal 400R", trade name; product of Cabot Company) were added into 300 parts of toluene to mix them. The resulting mixture was dispersed in a ball mill for 30 minutes at room temperature, thereby subjecting the carbon black to a surface treatment.

Thereafter, the dispersion was dried under reduced pressure to completely remove toluene.

In the manner similar to that in Example 1, 18 parts of the carbon black subjected to the surface treatment as described above were uniformly dispersed in a mixed monomer composed of styrene and butyl methacrylate. A toner was then prepared by subjecting the dispersion to a successive polymerization, washing and drying process.

Its particle size was 8.0 μm for volume average particle diameter and 7.3 μm for number average particle diameter, and it hence had an extremely narrow particle size distribution.

For the resulting toner, the carbon black was dispersed uniformly inside the particles. Its electric resistivity was 11.4 logΩ.cm, and its charge acceptance generated by triboelectrification against a carrier (TEFV 150/250) was −35 μc/q. The toner substantially contained no reversely charged particle and it was hence confirmed that the toner has performance extremely narrow in charge distribution.

EXAMPLE 4

Dispersed in an ball mill at room temperature, were 40 parts of styrene, 30 parts of butyl methacrylate, 10 parts of Dispersing agent II prepared in Synthesis Example, 100 parts of magnetic powder ("BL200", trade name; product of Titan Kogyo K.K.), 0.5 part of a dye ("Bontron S-34", trade name) and 2 parts of 2,2'-azobis(2,4-dimethylvaleronitrile), thereby obtaining an intimate mixture.

A toner was then prepared by subjecting the intimate mixture to a successive polymerization, washing and drying process in accordance with the same procedure as in Example 1.

For the resulting toner, the magnetic powder was dispersed uniformly inside the particles. Its electric resistivity was 10.7 logΩ.cm.

Using the toner, a twenty thousand-sheet continuous copy tests was conducted by the commercially available copying machine. The density of an image formed was 1.33, and were not reduced even upon the twenty thousandth copying. The image was free of any fog, unevenness and dust, and was vivid and hence good in quality.

We claim:

1. A process for the preparation of a toner, which comprises dissolving or dispersing a compound (A) having at least one $>C{=}N^{\oplus}<$ bond in its molecule and serving as a dispersing agent and a colorant (B) in a vinyl monomer (C), and then suspension-polymerizing the vinyl monomer (C) in an aqueous dispersion medium, said compound (A) being a polymer selected from the group consisting of (i) polymers having at least one heterocyclic structure containing a $>C{=}N^{\oplus}<$ bond in its molecule and obtained by reacting an organic compound (I) represented by the following general formula:

$$Y_1{-}CH{=}N{-}Y_2 \qquad (I)$$

wherein $Y_1$ and $Y_2$ individually represent an aliphatic, alicyclic or aromatic group and an organic acid halide with a polymer having at least one carbon-carbon unsaturated bond in its molecular chain in the presence of a Lewis acid; (ii) terminal-modified polymers obtained by reacting at least one compound selected from compounds having a $$-\underset{\underset{X}{\|}}{C}-N<$$

bond, wherein X represents an O or S atom, in their molecules, N-substituted aminoketones, N-substituted aminothioketones, N-substituted aminoaldehydes and N-substituted aminothioaldehydes to a terminal of a living anionic polymer obtained by polymerizing at least one monomer anion-polymerizable by at least one catalyst selected from alkali metal catalysts and alkaline earth metal catalysts, and then hydrolyzing the reaction product; and (iii) modified polymers obtained by adding at least one metal selected from alkali metals and alkaline earth metals to the double bond site in an unsaturated polymer, reacting the adduct with at least one compound selected from compounds having a $$-\underset{\underset{X}{\|}}{C}-N<$$

bond, wherein X represents an O or S atom, in their molecules, N-substituted aminoketones, N-substituted aminothioketones, N-substituted aminoaldehydes and N-substituted aminothioaldehydes, and then hydrolyzing the reaction product.

2. The process as claimed in claim 1, wherein the polymers (i) having at least one heterocyclic structure containing a $>C{=}N^{\oplus}<$ bond in its molecule are (1) polymers having 1,3-oxazine structures wherein the nitrogen atom in the heterocyclic group has been converted into a quaternary ammonium salt, (2) polymers having a 1,3-thiazine ring or 5H,6H-1,3-thiazine ring wherein the nitrogen atom in the thiazine ring has been converted into a quaternary ammonium salt, (3) polymers having an isoxazole ring or 4H, 5H-1,3-isoxazole ring wherein the nitrogen atom in the isoxazole ring has been converted into a quaternary ammonium salt, (4) polymers having a 1,2-diazole ring wherein the nitrogen atom in the diazole ring has been converted into a quaternary ammonium salt, or (5) polymers having a 2H-pyrrole ring or 2H,3H,4H-pyrrole ring wherein the nitrogen atom in the pyrrole ring has been converted into a quaternary ammonium salt.

3. The process as claimed in claim 1, which comprises dissolving or dispersing the colorant (B) which has been subjected in advance to a surface treatment with the compound having at least one $>C{=}N^{\oplus}<$ bond in its molecule and serving as a dispersing agent in the vinyl monomer.

4. The process as claimed in claim 2, wherein the colorant (B) is subjected to the surface treatment with the compound (A) by adding the colorant (B) to a solution of the compound (A) in an organic solvent to disperse the colorant (B) or spraying the organic solvent solution of the compound (A) on the colorant (B) and then drying the colorant (B) to remove the organic solvent.

5. The process as claimed in claim 1 or 3, wherein the compound (A) is polymer (i) having at least one heterocyclic structure containing a $>C{=}N^{\oplus}<$ bond in its molecule.

6. The process as claimed in claim 1 or 3, wherein the vinyl monomer (C) is at least one monomer selected from styrene monomers, acrylic acid, methacrylic acid, acrylic esters, methacrylic esters, ethylenically unsaturated monoolefins, vinyl halides, vinyl ethers, vinyl ketones and nitrogen-containing vinyl compounds.

7. The process as claimed in claim 1 or 3, which comprises optionally using, in addition to the vinyl monomer (C), a crosslinkable monomer in a range of 0–20 wt. % of the whole monomer component so as to copolymerize with the vinyl monomer.

8. The process as claimed in claim 1 or 3, wherein the colorant (B) is at least one selected from pigments, dyes and magnetic powders.

9. The process as claimed in claim 1 or 2, wherein the compound (A) is used in a range of 0.5–500 parts by weight per 100 parts by weight of the colorant (B).

10. The process as claimed in claim 1 or 3, which comprises dissolving or dispersing the compound (A) and the colorant (B) in the vinyl monomer (C) and then suspension-polymerizing the vinyl monomer (C) at 30°–200° C. in the presence of an oil-soluble polymerization initiator in the aqueous dispersion medium.

* * * * *

UNITED STATES PATENT AND TRADEMARK OFFICE

CERTIFICATE OF CORRECTION

PATENT NO. : 5,217,839
DATED : June 8, 1993
INVENTOR(S) : Fumio Yamada, et. al.

It is certified that error appears in the above-indentified patent and that said Letters Patent is hereby corrected as shown below:

Title page, item [73], Assignee: should read--Nippon Zeon Co., Ltd., Japan--.

Signed and Sealed this

Fourteenth Day of February, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,217,839

DATED : June 8, 1993

INVENTOR(S) : Fumio YAMADA et al.

It is certified that error appears in the above-indentified patent and that said Letters Patent is hereby corrected as shown below:

On the title page, please delete item [73] and insert the following therefor:

--[73] Assignee: Nippon Zeon Co., Ltd., Tokyo, Japan--

This certificate supersedes certificate of correction issued February 14, 1995.

Signed and Sealed this

Fourth Day of July, 1995

*Attest:*

Bruce Lehman

BRUCE LEHMAN

*Attesting Officer*

*Commissioner of Patents and Trademarks*